US007681784B2

(12) United States Patent
Lang

(10) Patent No.: US 7,681,784 B2
(45) Date of Patent: Mar. 23, 2010

(54) CONTAINER WITH INTEGRAL FOLDABLE LOCKING CLOSURE

(76) Inventor: Robert J. Lang, 899 Forest La., Alamo, CA (US) 94507

( * ) Notice: Subject to any disclaimer, the term of this patent is extended or adjusted under 35 U.S.C. 154(b) by 0 days.

(21) Appl. No.: 12/189,328

(22) Filed: Aug. 11, 2008

(65) Prior Publication Data

US 2009/0114710 A1 May 7, 2009

Related U.S. Application Data

(60) Provisional application No. 60/985,849, filed on Nov. 6, 2007.

(51) Int. Cl.
*B65D 3/20* (2006.01)

(52) U.S. Cl. ..... 229/138; 229/5.5; 229/404

(58) Field of Classification Search ..... 229/138–140, 229/5.5, 404

See application file for complete search history.

(56) References Cited

U.S. PATENT DOCUMENTS 657,473 A * 9/1900 Wagnitz ..... 229/138
2,058,592 A * 10/1936 Karlsson-Ygger ..... 229/5.5
2,074,824 A * 3/1937 Karlsson-Ygger ..... 229/5.5
2,091,291 A * 8/1937 Ringler ..... 229/138
3,549,081 A * 12/1970 Nelson ..... 229/138
3,799,425 A * 3/1974 Fanter ..... 229/126
4,712,725 A 12/1987 Moore
4,850,528 A * 7/1989 Hanus ..... 229/138
5,558,272 A * 9/1996 Magister ..... 229/138
5,676,306 A 10/1997 Lankin et al.
D410,196 S * 5/1999 Berg ..... D9/432

FOREIGN PATENT DOCUMENTS

GB 2380397 4/2003

OTHER PUBLICATIONS

Fujimoto, Shuzo, "Rittai Origami" published in 1976.
Fuse, Tomoko, "Ichimai Ori No Haku", published in 1992.
"Origami in Action", published in 1997.

* cited by examiner

*Primary Examiner*—Gary E Elkins
(74) *Attorney, Agent, or Firm*—Schneck & Schneck; Thomas Schneck; David M. Schneck

(57) ABSTRACT

A container with an integrated foldable closure system containing a secure locking mechanism. The container is provided with an upper edge divided by a series of mountain and valley folds into a set of triangular and quadrilateral panels. When the panels are folded down on the given folds, the panels interlock and extend beyond the centroid of the closure, thereby providing a secure locking mechanism. Also disclosed is a simple method for closing said container.

7 Claims, 3 Drawing Sheets

CONTAINER WITH INTEGRAL FOLDABLE LOCKING CLOSURE

CROSS-REFERENCE TO RELATED APPLICATION

This application claims priority from U.S. provisional application No. 60/985,849, filed Nov. 6, 2007.

TECHNICAL FIELD

This invention relates to a container of foldable material incorporating an integral closure formed by folding portions of the container. The closure makes the container suitable for beverages, food, other consumables, and other products.

BACKGROUND

Many industries require containers for particulate, semi-solid, or liquid products. Such containers must be sturdy and inexpensive. These requirements are particularly acute within the fast-food industry for beverage containers, as well as in the dairy products industry. Because of the economies, such containers must be quite inexpensive and must incorporate closures, e.g., lids, to prevent spillage of their contents. Because fast-food goods must be prepared fast, it is important that when a beverage is filled, it can be closed quickly and easily by a relatively unskilled labor force. In addition, because many such beverages are transferred in mechanically unstable environments, e.g., automobiles, cup holders, and laps, the containers must be secured against spillage and leakage.

The current state of the art, in use across the take-away food industry, uses a two-part container, consisting of a waxed paper or plastic cup, together with a separate, usually plastic, lid. The lid clips into place over a rolled rim on the cup. The lid may also be perforated by one or more holes to allow limited access to the fluid (e.g., a slit in the rim of a coffee cup), or to allow insertion of a straw.

Using a separate plastic lid presents several undesirable aspects. First, two different vendors and supply streams must be supported, adding to operational cost. Second, the lids themselves are inconvenient to work with, often sticking together, or getting dropped and leading to excess wastage. Third, plastic lids are perceived as less environmentally desirable than, e.g., paper cups. Fourth, a plastic lid can easily be imperfectly attached, leading to a phenomenon where the lid is popped off by moderate pressure placed on the cup. Fifth, if the cup is inadvertently jostled or knocked over, the lid can pop off, spilling the entire contents of the cup.

These drawbacks lead to higher operating costs and reluctance on the part of consumers to purchases beverages in such cups in unstable environments such as drive-through ordering environments.

It would lead to significant benefits such as cost reduction if the separate lid could be eliminated and the closure of the container obtained by modifying the cup itself. There would be less inventory, less wastage, and the closure would now be made of the same material as the cup, which could be paper or an even more environmentally benign material.

Furthermore, it would be a benefit if an integrated closure could be realized that provided better resistance to undesired leakage and/or opening than the traditional plastic lid.

It would also be a benefit if the integrated closure could be quickly and easily closed by a relatively unskilled employee, and if the integrated closure could provide a positive indication that closure had been achieved.

An integral closure may be realized by adding a series of folds to the container which, when activated, create the closure from the same material as the rest of the container.

A fold may be characterized as being either a mountain fold, in which the activated fold is convex toward the outside of the container, or a valley fold, in which the activated fold is concave toward the outside of the container (and thus is convex toward the interior of the container).

In the prior art, U.S. Pat. No. 4,712,725 ('725 hereafter) discloses a container with an integral fold-in closure lid, as shown in FIGS. 1(*a*)-(*c*). FIG. 1(*a*) shows a side view of the container; FIG. 1(*b*) shows a top view of the container; and FIG. 1(*c*) shows a plan view of the blank from which the container is fabricated. In this patent, the top edge of the cup is divided by a series of triangular folds into a large number of triangular panels. The folds consist of two types: "mountain" folds, which are peaked toward the observer, and "valley" folds, which are peaked away from the observer. These panels are folded down around the lid so that all edges meet in the middle of the cup to effect a closure. The patent discloses that any number of segments may be used, but a preferred embodiment uses twelve segments.

The container of '725 offers the advantage of an integral closure, but it also has several disadvantages. The relatively large number of segments means that many different segments must be simultaneously manipulated. Furthermore, the locking mechanism is not particularly strong, and empirical tests reveal that a cup fabricated according to any of the disclosed embodiments are relatively susceptible to having the lid pop open under relatively minor stresses. It should be noted that among all of the variations described and disclosed in '725, they all share the property that the valley folds extending from the rim of the cup terminate in the very center of the cup.

Another patent in the prior art, U.S. Pat. No. 5,676,306 ('306 hereafter) also discloses a container with an integral fold-in closure lid. In this patent, the top edge of the cup is divided by series of triangular folds into a large number of triangular and quadrilateral panels. These panels are formed in concert with a recessed rim composed of two parallel closely-spaced creases running around the rim of the cup. When the panels are folded down, they form a closure of the top of the cup. The pattern of the creases around the rim is similar to the pattern of the creases in '725, but the locations, angles, and fold angles of the creases differ from those in '725 so that while the flanges formed by the mountain folds in '725 stand straight up and down, the flanges formed by the mountain folds in '306 run sideways and overlap one another. The closure of '306 and closure of '725 share the important property that the valley folds run from the rim of the cup into the very center of the closure where the paper terminates. No valley fold extends beyond the center when the closure is engaged, and in fact no paper extends beyond the center in '306 except for a tab provided for re-opening the container; the tab plays no role in holding the closure shut.

The container in '306 shares a disadvantage with '725, that it is still relatively weak and lateral stresses easily dislodge the closure.

Furthermore, the preferred embodiments of the invention of '306 utilizes six or twelve flanges, so that when closing the cup, all six flanges must be simultaneously manipulated, thus requiring a skilled operator to quickly effect closure of the container. This closure is made particularly difficult in that each pair of adjacent mountain and valley folds are only weakly coupled to one another, so that individual folds can, and in fact, must be operated simultaneously by the user, requiring considerable physical dexterity.

Another patent in the prior art, GB Patent No. 2,380,397 ('397 hereafter) discloses a container with an integral fold-in closure lid. In this patent, the top edge of the cup is divided by a series of triangular folds into a large number of triangular and quadrilateral panels. When the panels are folded down, their edges meet in the center of the cup and they form a closure of the top of the cup. The pattern of the creases around the rim is similar to the pattern of the creases in '725, but all folds are straight so that the top of the cup is forced into a polygonal, rather than conical cross section.

'397 discloses several different embodiments in which the parity of the creases differs from one embodiment to the next. For example, in their FIG. 10-11, the vertical folds are valley folds and the diagonal folds are mountain folds, whereas in their FIG. 13, the vertical folds are mountain folds and the diagonal folds are valley folds. Common to all embodiments disclosed in '397 that have vertical and diagonals folds is the property that the vertical folds meet and terminate in the center of the cup. This property results in a weak and easily dislodged closure, as it does in '725 and '306.

It would be desirable to use a different folding pattern from those disclosed in the aforementioned containers. There are several patterns within the origami literature that are somewhat similar to the folding patterns disclosed in this prior art, which can be applied to a polygonal or cylindrical shape to effect a closure.

In the book, "Rittai Origami," written by Shuzo Fujimoto and published in 1976, there is disclosed several polygonal decorative forms in which the upper end of a roughly cylindrical faceted form is patterned with a series of vertical mountain folds and diagonal valley folds. See FIGS. 41-1, 41-2, 42-1, 42-3, 43-1, and 43-2. When the folds are activated, the top of the shape twists to form a flat closure. The dimensions of the shape and fold angles are chosen so that the valley folds extend well beyond the center of the folded shape, in contrast to the aforementioned prior art. However, this form is presented as a decorative shape, rather than a container. Also, the angles are chosen so that the top lies flat with no recess, so that there is no tensional force keeping the twist in place.

In the book, "Ichimai Ori No Haku", written by Tomoko Fuse and published in 1992, there are disclosed a multiplicity of two-piece boxes in which the lids of said boxes are folded by creating a pattern of vertical mountain and diagonal valley folds that, when activated, twist to form a flat structure. While the pattern is superficially similar to the folding patterns already presented and the pattern of the present invention, the twist fold is used merely as a decorative element and is not intended to be opened and closed; instead, the container on which it is used is opened by merely lifting off the separate piece comprising the lid.

In the book "Origami in Action," written by the inventor and published in 1997, there is also disclosed a cylindrical form in which vertical mountain folds and diagonal valleys are created so that when all folds are activated, the top of the form twists to form a flat closure in which the valley folds extend well beyond the center of the twist. However, this pattern is again used as a decorative form rather than as a functional element in a container.

It is the object to provide a container with an integrated folding closure that provides a more secure lock than that provided by the prior art.

It is a further object to provide a method for closing the container that requires minimal manipulation, so that a skilled operator can quickly execute the closure in a secure manner.

It is a further object to provide means for decoration and/or advertisement on the finished lid.

DETAILED DESCRIPTION

Figure 1A:
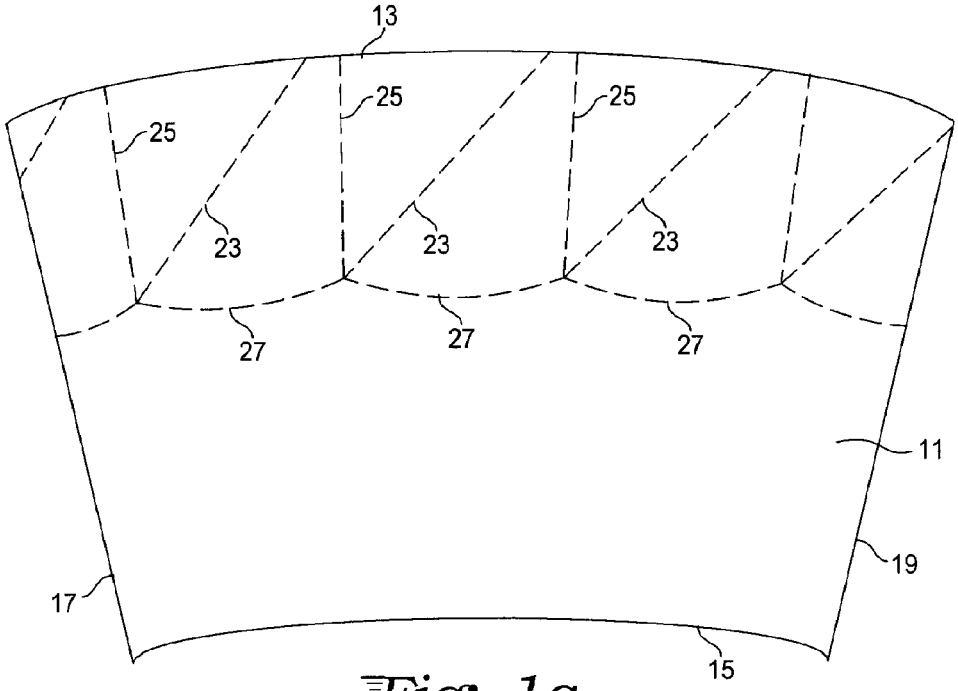
FIG. 1*a* is a plan view of a sheet showing edges and folds for forming a paper container of the present invention.

With reference to FIG. 1*a*, a sheet 11 is shown having top edge 13, bottom edge 15 and side edges 17 and 19. The illustrated embodiments show a cylindrical or conical container formed by joining side edges 17 and 19 and providing an integrated bottom as a separate member 21, as in FIG. 1*b*. The top edge 13 is dissected by a pattern of prospective folds 23, 25, 27 around the rim that permit a full closure of the container by creating creases along the folds in a regular pattern.

Apart from the folding pattern, the container itself may be formed by any of several means known in the art. For example, a cup may be formed by joining the edges of a section of an annulus, then joining the resulting frustum to a circular base, using the same process as most commercial paper cups. Alternatively, the cup may be formed from plastic by various means, including thermoforming, blow-molding, or many others generally known in the art, so long as the material is foldable.

The folds may be defined in several ways. If the container is formed of paper, cardboard, or other paper-like material, the fold lines may be defined by scoring or partially or wholly perforating the material along the fold line to selectively weaken it, or merely marking the material in some manner, such as printing. If the container is molded, for example, from plastic, the fold lines may be molded to be thinner than the rest of the body of the container so as to provide a natural weakness in the cup. It should be understood that other methods of forming a fold line may be employed without changing the essential characteristics of the invention.

Figure 1B:
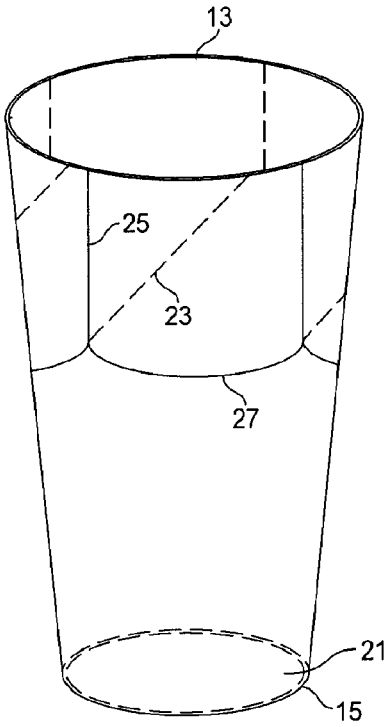
FIG. 1*b* is a front view of a partially assembled container of FIG. 1*a*.
Figure 2:
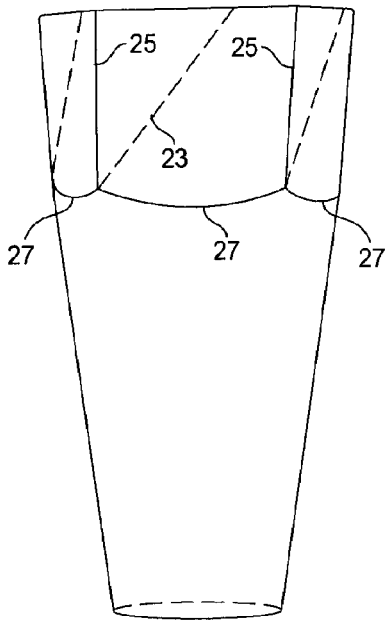
FIG. 2 is a side view of the partially assembled container of FIG. 1*a*.

In FIG. 2, the folds consist of three sets of folds 23, 25, and 27, as illustrated in FIGS. 1*a* and 1*b*.

The first set of folds 27 are mountain folds that run circumferentially around the cup. The folds 27 are preferentially arcuate. The second set of folds 25 consists of mountain folds that are aligned predominantly parallel with respect to the axis of the container. These folds must be straight lines so that when the folds are formed, the layers on either side of the fold are brought into contact with each other on their interior surfaces.

The third set of folds 23 consists of valley folds which emanate from the intersections of the first and second sets of folds and proceed upward, inclined at a given angle with respect to the vertical second set of folds. These folds are preferentially straight folds, but may also be slightly curved.

Figure 3:
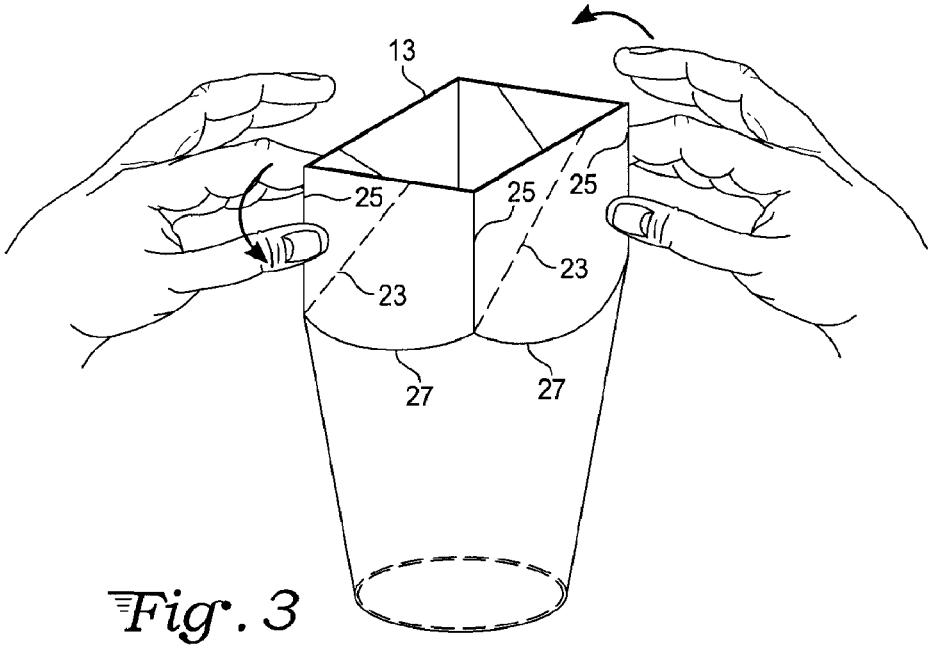
FIG. 3 is perspective view of a folding operation for the container of FIG. 2.

When the container is to be closed, as seen in FIG. 3, the first set of folds 27 are folded towards a dihedral angle of around 90 degrees or slightly less, so that the upper edges of the container fold in toward the center. In this regard, the motion is superficially similar to that described by U.S. Pat.

No. '306, in which the tops of the valley folds are brought into near coincidence in the center of the cup and the folded layers remain locally flat. In the structure of '306, the layers "collide" in the center, which sets a limit on the width of the region between the first set of mountain folds and the top of the cup. Unfortunately, this makes the locking between the layers relatively insecure and it is easily opened, e.g., by sloshing of the interior contents.

In the present invention, the first set of folds 27 forms a rim for the top of the container upward and extend the second and third set of folds 25 and 23, are folded to meet toward the rim; at the same time we incorporate a slight curvature in the layers on either side of the second set of mountain folds when the closure is engaged. This innovation allows the layers to extend well beyond the geometric center of the closure of the cup, in contrast to the disclosures of '725 and '306, providing a much more secure lock. Furthermore, natural springiness of the cup material, such as paper, will slightly resist the curvature in the closed form, which forces the layers of paper together, providing a more secure seal that that in the prior art. Lastly, by extending the layers of paper beyond the center of the closure in the closed state, larger flaps are provided to the user, making it easier to manipulate the closure.

Figure 5:
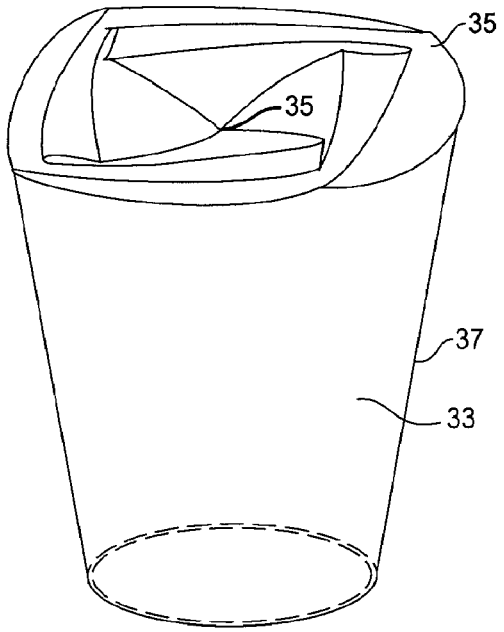
FIG. 5 is a perspective view of the container of FIG. 2 with the top closed.

In FIG. 5, the angle of the valley folds is chosen so that when the closure is engaged, the center point 31 of the cup 33 lies a short distance below the outer rim 35 of the top of the closed container, so that the elastic force of the side 37 provides both an inward force and a downward force on the closure layers, thereby giving a tighter seal than that provided in the prior art.

Figure 6:
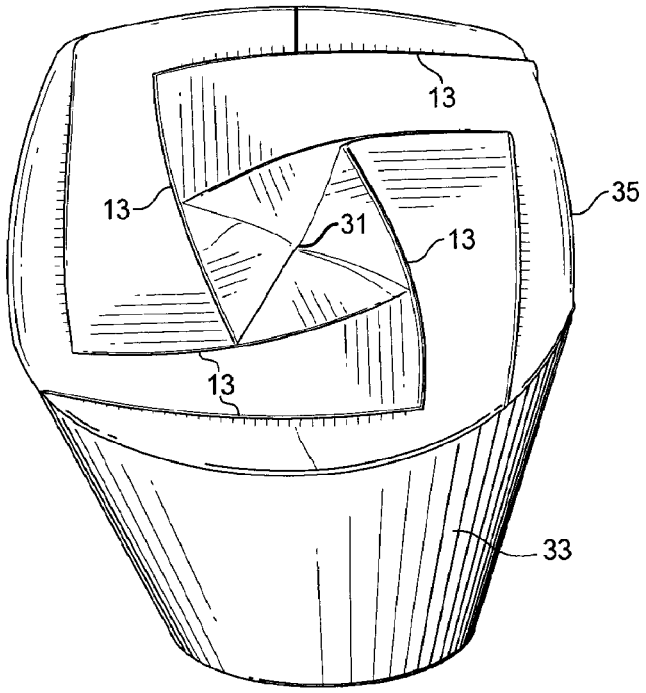
FIG. 6 is a top view of a closed container of FIG. 5.

Thus, in FIG. 6 the top edge 13 of the unfolded container end up lying some distance from the center 31 of the container 33 when closed. A preferred amount is between halfway to the rim 35 and at the rim itself, but it will be appreciated that the closure may be designed so that the top edges lie closer to the center or even beyond the rim.

Figure 4:
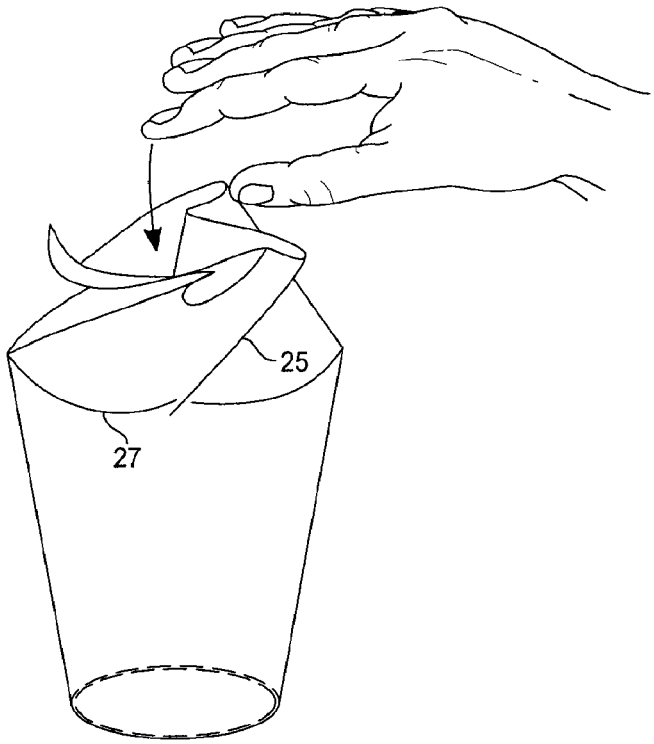
FIG. 4 is perspective view of a further folding operation for the container of FIG. 2.

This invention allows a very simple form of the closure that permits a relatively unskilled operator to quickly and securely close the container. In a preferred embodiment, the second set of folds consists of four vertical folds, which we may label D-G as in FIG. 3. The present invention permits a method of closure that requires only two motions. The user grasps two opposite mountain folds (M1, M2 of FIG. 4), pinches the folds into place, and then shifts the two flaps in opposite directions. The innovation of extending the valley folds (V1 of FIG. 4) couple the motions of all four flaps so that all four flaps form a spiral shape, as in FIGS. 4, 5, 6. The user then releases the flaps and pushes down on the center I of the container. As the crossing point of the spiral moves below the height of the new folded rim, the force resisting closure changes to a force in the direction of closure, and the container "pops" into its final form with the center point lying below the height of the rim, in which the elastic forces of the container resist re-opening.

The flaps effecting the closure (T1, T2 in FIG. 6), being relatively larger than those in the prior art, may be pulled upward to re-open the container. They are sufficiently large that no extra pull tab is required.

It should be noted that while four vertical folds is the preferred embodiment, three, five, or a larger number of folds may be used, depending on tradeoffs between ease of use, amount of excess material required for the closure, and desire for decorative effect.

While the preferred shape of the top edge of the container is a smooth curve for simplicity, it may be desirable to cut the top edge in a curved or more decorative fashion so that the folded cup forms a floral or other decorative pattern.

While it is common in the art to print a decorative pattern on the outside of a container, this invention offers the capability that if one prints a decorative pattern on the inside near the rim, the decorative pattern is exposed when the container is closed, allowing novel effects for decoration and/or advertising.

It will be appreciated that many variations are possible that incorporate the same basic invention. For example, a second set of axial folds parallel to the first set of mountain folds could be formed to create a slight rim on the cup. The container could be conical or cylindrical. It could also be made with a polygonal cross section. It could be formed of many different materials, including paper, cardboard, plastic, metal, composites, and laminates of same by many different manufacturing processes. If molded, the panels between the folds could be given curvatures different from the curvature of the container below the set of folds. All of these variations could be incorporated in conjunction with the given invention, whose essential nature is the formation of panels that, when closed, extend substantially beyond the center of the closure.

What is claimed is:

1. A container comprising:

a bottom; and a cylindrical or conical sidewall, wherein the upper portion of said sidewall is formed with a set of creases defining a foldable closure, said creases including three sets of creases;

a first set of mountain creases including curved arcs proceeding around the circumference of said sidewall;

a second set of mountain creases that extend from vertices of said first set upward to the upper edge of said sidewall;

a third set of valley creases extended from said vertices of said first set upward to the upper edge of said sidewall, each disposed at an angle relative to an adjacent mountain crease from said second set;

said mountain and valley creases dividing the upper portion into a series of geometric panels;

said creases formed so that when all creases are folded, the panels form a barrier above the contents of said container, and each of said valley folds cross in the center of said closure, and said valley folds extend substantially beyond the center of said closure.

2. The container of claim 1 wherein when all creases are folded a position where said valley folds cross one another lies below the level of said first set of mountain creases.

3. The container of claim 2 where an upper edge of said conical sidewall is formed with a non-circular profile that creates a decoration when the container is folded.

4. The container of claim 1 wherein when all creases are folded layers of paper incident to the second set of mountain folds are curved in an orientation approximately parallel to said first set of mountain folds.

5. The container of claim 2 wherein a decorative pattern is printed on an interior surface of the container near an upper edge of said sidewall so that said decorative pattern is exposed when said container is closed.

6. The container of claim 2 wherein said sidewall is predominantly polygonal with flat regions and/or vertical creases.

7. The container of claim 1 wherein each of said valley creases divides an area in between two mountain creases of said second set of mountain creases into two geometric panels.

* * * * *